United States Patent [19]

Hegewaldt et al.

[11] Patent Number: 4,486,889

[45] Date of Patent: Dec. 4, 1984

[54] CONTINUOUS-FLOW HEATER FOR MOLTEN METALS

[75] Inventors: Fritz Hegewaldt, Herdecke; Erwin Dötsch, Dortmund-Holzen, both of Fed. Rep. of Germany

[73] Assignee: Brown, Boveri & Cia AG, Mannheim, Fed. Rep. of Germany

[21] Appl. No.: 519,096

[22] Filed: Aug. 1, 1983

[30] Foreign Application Priority Data

Aug. 6, 1982 [DE] Fed. Rep. of Germany ..... 3229367

[51] Int. Cl.[3] ..... F27D 3/14

[52] U.S. Cl. ..... 373/142

[58] Field of Search ..... 373/141, 142, 146, 156, 373/115, 46

[56] References Cited

U.S. PATENT DOCUMENTS

| | | | |
|---|---|---|---|
| 3,056,847 | 10/1962 | Junker | 373/141 |
| 3,230,073 | 1/1966 | Ericsson | 373/146 X |
| 3,472,942 | 10/1969 | Campbell | 373/142 |
| 3,819,842 | 6/1974 | Gesek et al. | 373/142 |

*Primary Examiner*—Roy N. Envall, Jr.

*Attorney, Agent, or Firm*—Herbert L. Lerner; Laurence A. Greenberg

[57] ABSTRACT

Induction crucible furnace for maintaining or increasing the temperature level of a metal melt, characterized by the feature that the inlet of the melt to the crucible furnace is arranged below the bath level in the furnace.

6 Claims, 4 Drawing Figures

CONTINUOUS-FLOW HEATER FOR MOLTEN METALS

BACKGROUND OF THE INVENTION

1. Field of the Invention

The invention relates to a continuous-flow heater for molten metal, for instance, an induction crucible furnace for maintaining or increasing the temperature level of a metal melt.

2. Description of the Prior Art

In metallurgy it is often necessary to bring large quantities of a molten metal from one temperature level to a higher temperature level or, if the melted amount of metal cannot be poured immediately, to maintain the temperature level of the molten metal. This can take place either in batch operation or continuously in a continuous-flow heater. In principle, any known electrically heated melting furnace can be used for this purpose.

If an arc furnace is used for heating the metal melt in batches, it must be noted however that the efficiency of the arc furnace for this type of operation is very low and that reactions on the melt to be heated can occur. At the base of the arc furnace, very high temperatures occur which can lead to the evaporation of the melt and therefore of the alloy elements and can promote the absorption of nitrogen into the melt. If graphite electrodes are used, the melt, in addition, can absorb carbon.

While arc furnaces can be used for batch-wise heating, induction channel furnaces are available for continuous flow operation. Batch-wise operation with an induction channel furnace, on the other hand, is difficult for larger units and outputs because the temperature variations connected therewith, in particular in the refractory lining of the inductors, lead to considerable problems. Accordingly, changes in alloys and grade require a considerable expenditure of technical means.

To avoid the disadvantages of the arc furnace and the induction channel furnace, the induction crucible furnace—a furnace in which the crucible is heated from outside by electrically induced currents—has been used for batch-wise heating. Also special designs of induction crucible furnaces have already been used for heating in continuous flow operation. A tube with refractory lining which was provided for feeding-in the melt to be heated was brought through the rocker bearing of the induction crucible furnace. The discharge took place via a spout which was open or designed as a syphon, by tilting the induction crucible furnace. In another induction crucible furnace, the melt is fed-in through a slot provided in the lid. In both embodiments it was necessary to replace the crucible at shorter intervals than in normal induction crucible furnaces. Considerable war occurred mostly in the region of the crucible wall.

SUMMARY OF THE INVENTION

It is an object of the invention to provide an induction crucible furnace adapted for continuous flow operation in which the service life of the crucible corresponds approximately to the service life of the crucible in a normal induction crucible furnace.

With the foregoing and other objects in view, there is provided in accordance with the invention an induction crucible furnace with means for feeding molten metal into the crucible and means for discharging molten metal from the crucible adapted for a continuous-flow heater for molten metals for maintaining or increasing the temperature level of a metal melt in the crucible, the combination therewith of an inlet for feeding molten metal into the crucible arranged below the bath level of the metal melt in the furnace.

Other features which are considered as characteristic for the invention are set forth in the appended claims.

Although the invention is illustrated and described herein as embodied in a continuous-flow heater for molten metals, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with, the accompanying drawings, in which.

DETAILED DESCRIPTION OF THE INVENTION

According to the invention, the input of the melt to the crucible furnace is arranged below the bath level in the furnace. One means of accomplishing this is to provide an inlet for the melt input to the crucible furnace in the bottom of the crucible. The pouring of the melt from the crucible can then be through the spout. Outlet means for the discharge of melt from the crucible can also be provided in the bottom of the crucible. Such an induction crucible furnace with inlet and outlet in the bottom is particularly suitable if the treatment vessel is to be evacuated in addition.

Schematic embodiment examples of the invention are shown in FIGS. 1-4.

Figure 1:
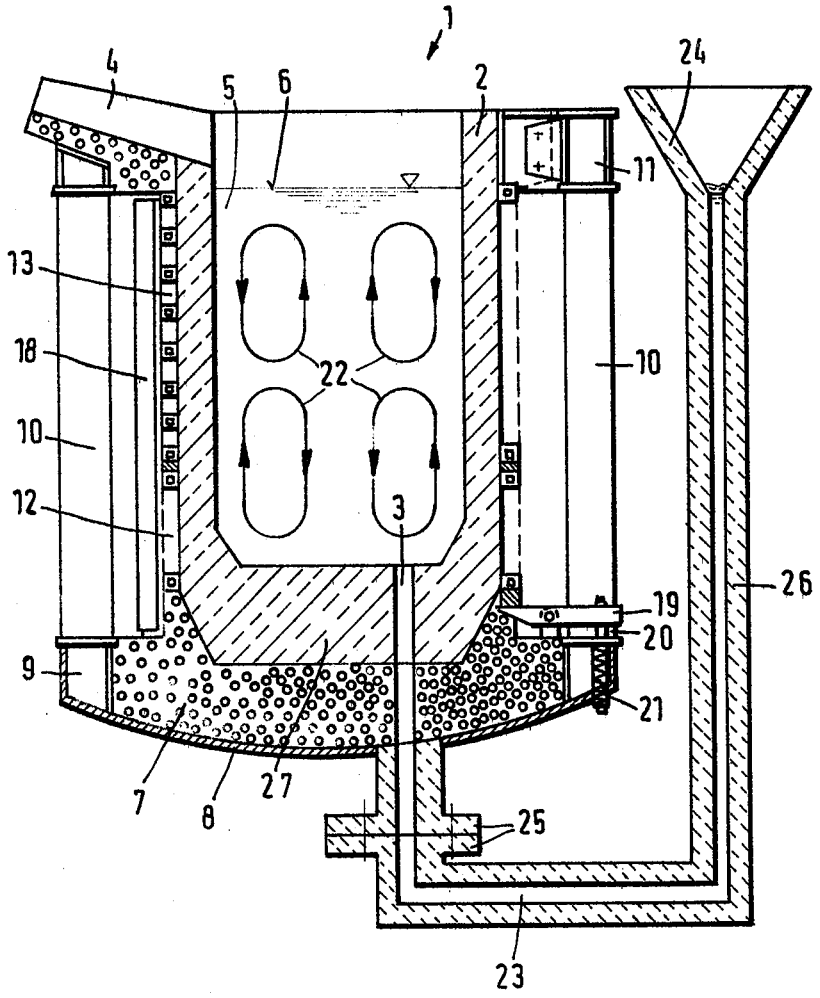
FIG. 1 diagrammatically illustrates an induction crucible furnace in accordance with the invention with the melt fed in at the bottom of the crucible and the melt discharged from the crucible through a pouring spot. The crucible is cylindrical, open at its top and closed at its bottom except for an opening for feeding melt into the crucible. A vertical connecting tube with a funnel at its top connects with the opening in the bottom of the crucible to feed the melt. External heating of the coil is by means of coil surrounding the cylindrical surface of the crucible. A pouring spout is provided for discharging the melt from the crucible upon tilting the crucible.

FIG. 1 shows an induction crucible furnace 1 with a cylindrical crucible 2 which is provided with an inlet 3 for the melt and a pouring spout 4 for discharge of melt. The crucible 2 is filled with melt 5 up to the bath level or liquid level 6. The crucible 2 is mounted on a refractory bottom 7 which is supported on a metallic bottom plate 8. The metallic bottom plate 8 together with a lower reinforcement ring 9, vertical struts 20 and an upper reinforcement ring 11, forms the furnace frame. The reinforcement ring 11 is in the region of the pouring spout 4 to enable the pouring spout 4 to rest on it. The crucible 2 is surrounded by a coil insert 12 and 13. Magnet yokes 18 represent the magnetic return for the lines of force produced in the active coil.

At the lower end of the coil insert are clamping devices which consist of a lever 19, a screw spindle 20 and a compression spring 21. The coils 12 and 13, by means of the clamping device, are pushed against the reinforcement ring 11.

The bath motion or local circulation of the melt 5 in the crucible 2 generated by the induction is indicated by the lines 22. The inlet opening 3 in the crucible bottom 27 is connected to the connecting tube 23, which leads to the funnel 24, via flanges 25 or the like. For this purpose, a pipeline with a refractory lining has been used. This pipeline is further provided with heat insulation 26 in order to prevent heat radiation to the outside and excessive cooling of the melt contained in the pipeline. The static bath pressure in the furnace which corresponds to the bath level 6 and that in the inlet line 23 or the funnel 24 must be equal. It is therefore possible to influence the bath level in the furnace 6 via the bath level in the line 23 or funnel 24.

Figure 2:
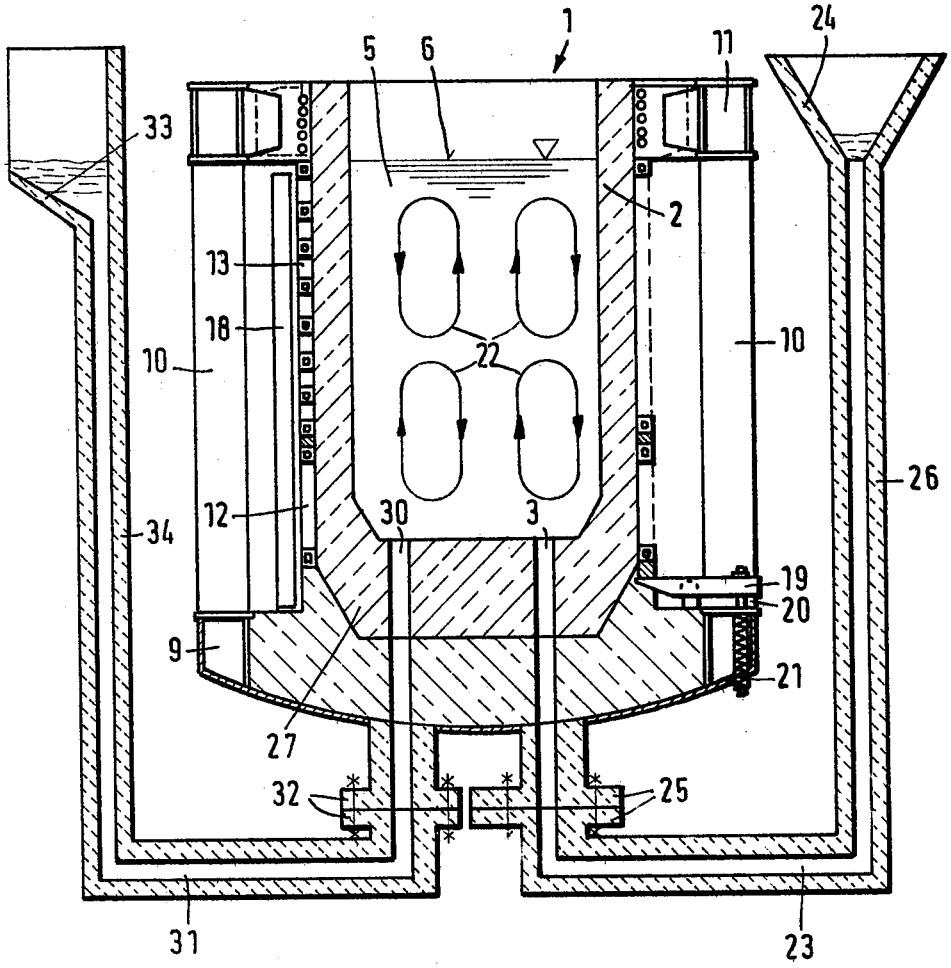
FIG. 2 is a modification of FIG. 1 showing an induction crucible furnace with an inlet and an outlet in the bottom.

FIG. 2 shows another embodiment of FIG. 1. The discharge opening 30 for the melt, like the inlet opening 3, is arranged in the bottom 27 of the crucible 2, whereas there is no discharge opening in the bottom 27 of the crucible 2 of FIG. 1.

A connecting line 31 is connected to the discharge opening 30 via flanges 32 and line 31 then rises to the pouring spout 33. Line 23 and line 31 have refractory linings and heat losses are minimized by covering lines 23 and 31 with thermal insulation 26 and 34, respectively. Although the inlet opening 3 and the outlet opening 30 are located close together, there is no difficulty because a direct passage of the melt from the inlet to the outlet is prevented by the strong stirring action of the induction current. The local circulation or bath motion of the melt is indicated by lines 22. In the embodiments shown in FIGS. 1 and 2, the device can be drained at the end of the treatment by tilting or, if the induction crucible furnace cannot be tilted, via a bottom plug, not shown.

Figure 3:
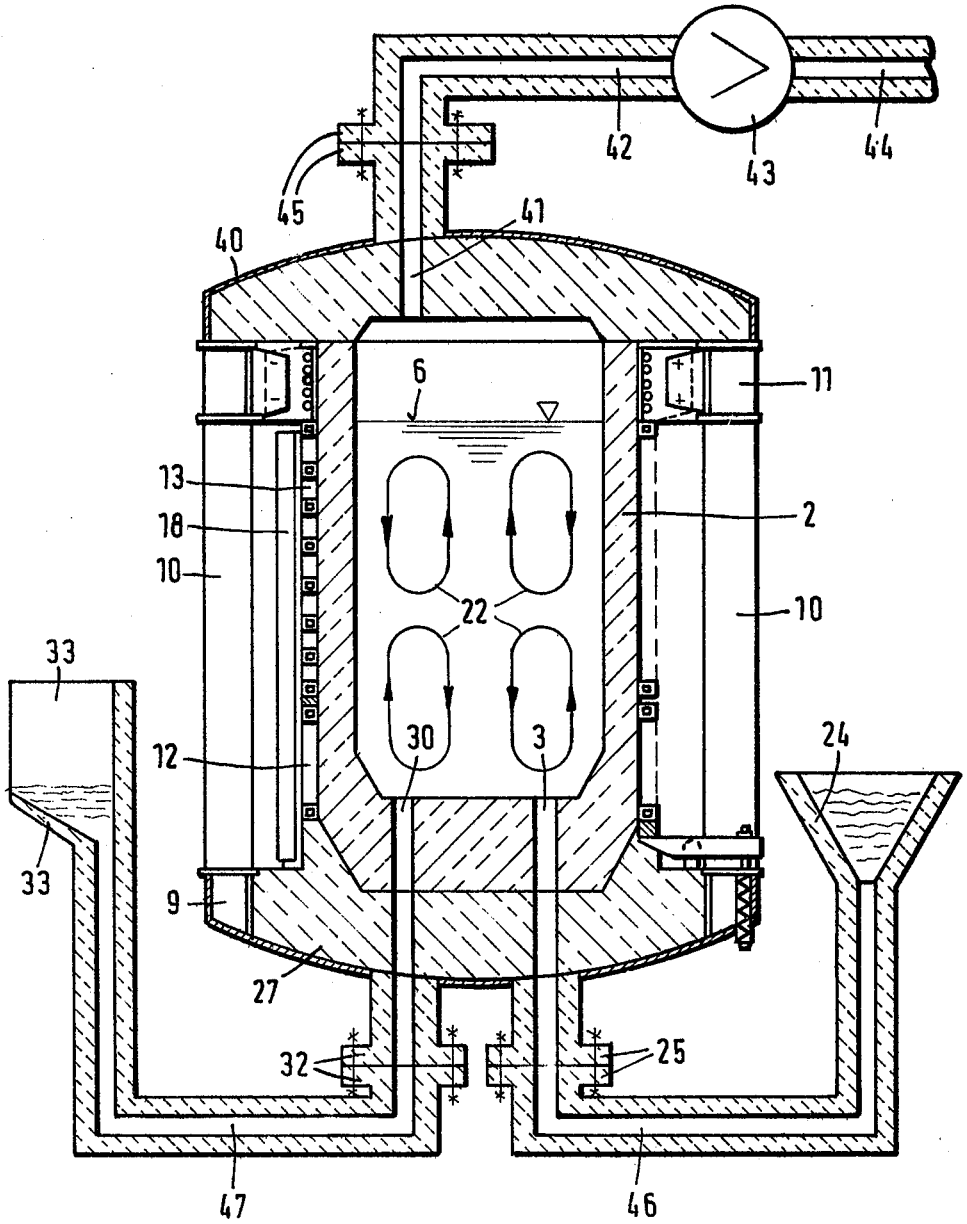
FIG. 3 is a vacuum-tight embodiment of FIG. 2 with a vacuum pump for drawing off the atmosphere above the bath level.

FIG. 3 shows a further embodiment of the invention, in which the crucible 2 is provided with a lid 40 which closes the crucible 2 tight for operation under a vacuum. The atmosphere above the bath level 6 can be drawn-off through the opening 41 by means of a vacuum pump. The vacuum pump 43 is connected on its suction side to the opening 41 via the connecting line 42 and the flanges 45. The gases removed from the atmosphere above liquid level 6 in crucible 2 through opening 41 and connecting line 42 are discharged by vacuum pump 43 through line 44. In this arrangement heating of melt 5 in crucible 2 can be combined with a simultaneous application of vacuum. The latter is particularly practical since, due to the already mentioned strong bath motions in the induction crucible furnace, practically all parts of the melt are washed to the bath surface and are therefore subjected directly to the action of the vacuum.

In addition, this arrangement has the further advantage that the inlet and outlet points 24 and 33 can be lower than in the embodiment according to FIG. 2. This has the advantage that after a treatment, i.e., after the vacuum is removed, less residual melt remains in the treatment unit. In addition, the connecting lines 46 and 47 are naturally shorter.

Figure 4:
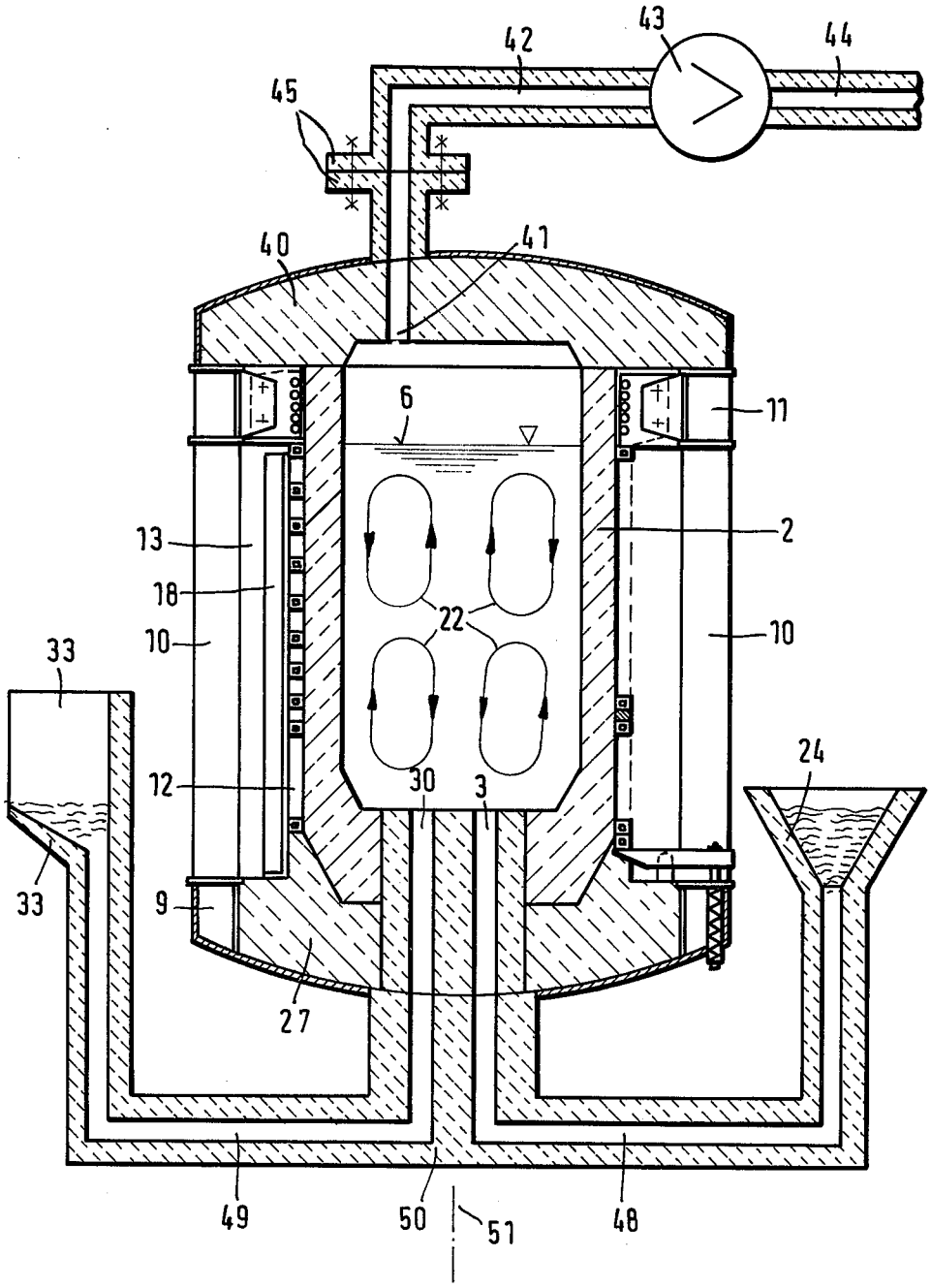
FIG. 4 is a variant of FIG. 3, in which the inlet and the outlet form a structural unit and can be used as a sliding shut-off valve.

FIG. 4 shows an embodiment with the inlet and outlet lines 48 and 49 as one structural unit 50. This embodiment has the further advantage that the unit 50 can be turned about its vertical axis which coincides with the vertical axis 51 of the crucible furnace, such that the inlet opening 3 and the outlet opening 40 are shut off. This unit acts as a sliding valve.

The invention is not limited to the embodiment examples shown, in particular, the inlet can also be designed differently.

Thus, the invention provides an induction crucible furnace as continuous flow heater for molten metals for maintaining or increasing the temperature level of the metal melt and for increasing the service life of the crucible such that it corresponds approximately to the service life of the crucible in a normal induction crucible furnace, by arranging the inlet of the melt to the crucible furnace below the bath level in the furnace, for instance, in the bottom of the crucible. The pouring can be accomplished via the spout or also via an outlet provided in the bottom of the crucible.

The foregoing is a description corresponding, in substance, to German application No. P 32 29 367.4, dated Aug. 6, 1982, international priority of which is being claimed for the instant application, and which is hereby made part of this application. Any material discrepancies between the foregoing specification and the specification of the aforementioned corresponding German application are to be resolved in favor of the latter.

We claim:

1. Induction crucible furnace with means for feeding molten metal into the crucible and means for discharging molten metal from the crucible adapted for a continuous flow heater for molten metals for maintaining or increasing the temperature level of a metal melt in the crucible, said means for feeding comprising an inlet for feeding said molten metal into the crucible arranged below the bath level of the metal melt in the furnace.

2. Induction crucible furnace according to claim 1, wherein the inlet for feeding molten metal into the crucible is in the bottom of the crucible.

3. Induction crucible furnace according to claim 2, wherein an outlet for discharging molten metal from the crucible is in the bottom of the crucible.

4. Induction crucible furnace according to claim 1, wherein a lid closes the crucible tight for operation under a vacuum, and wherein a vacuum pump is connected on its suction side to the space in the crucible above the bath level.

5. Induction crucible furnace according to claim 2, wherein a lid closes the crucible tight for operation under a vacuum, and wherein a vacuum pump is connected on its suction side to the space in the crucible above the bath level.

6. Induction crucible furnace according to claim 3, wherein a lid closes the crucible tight for operation under a vacuum, and wherein a vacuum pump is connected on its suction side to the space in the crucible above the bath level.

* * * * *